US006776318B2

(12) United States Patent
Washington

(10) Patent No.: US 6,776,318 B2
(45) Date of Patent: Aug. 17, 2004

(54) MOBILE PHONE HOLDER

(76) Inventor: John D. Washington, 3518 N. Chambers, Scottsdale, AZ (US) 85251

( * ) Notice: Subject to any disclaimer, the term of this patent is extended or adjusted under 35 U.S.C. 154(b) by 2 days.

(21) Appl. No.: 10/104,226

(22) Filed: Mar. 21, 2002

(65) Prior Publication Data

US 2002/0134804 A1 Sep. 26, 2002

Related U.S. Application Data

(60) Provisional application No. 60/277,707, filed on Mar. 21, 2001.

(51) Int. Cl.[7] ..... A45F 5/00

(52) U.S. Cl. ..... 224/251; 224/250; 224/676

(58) Field of Search ..... 224/251, 250, 224/919, 660, 663, 664, 676, 678, 914, 673, 930, 264, 257

(56) References Cited

U.S. PATENT DOCUMENTS

| | | | | | |
|---|---|---|---|---|---|
| 3,435,867 | A | * | 4/1969 | Hyden | 224/613 |
| D346,815 | S | | 5/1994 | Wake | |
| 5,410,762 | A | * | 5/1995 | Maskovich | 2/338 |
| 5,511,704 | A | * | 4/1996 | Linderer | 224/245 |
| D370,776 | S | * | 6/1996 | Frey | D3/218 |
| 5,526,924 | A | | 6/1996 | Klutznick | |
| 5,622,294 | A | * | 4/1997 | Evans | 224/184 |
| 5,653,336 | A | | 8/1997 | Buonaiuto et al. | |
| 5,772,090 | A | * | 6/1998 | Rodriguez | 224/251 |
| 6,003,747 | A | * | 12/1999 | Lee | 224/250 |
| 6,182,878 | B1 | | 2/2001 | Racca | |
| 6,234,307 | B1 | * | 5/2001 | Beck | 206/315.9 |
| 6,467,661 | B1 | * | 10/2002 | Mistretta et al. | 224/264 |
| 6,474,520 | B1 | * | 11/2002 | Finkelstein | 224/267 |
| 6,536,639 | B1 | * | 3/2003 | Frank | 224/257 |

* cited by examiner

*Primary Examiner*—Lee Young
*Assistant Examiner*—Maerena W. Brevard
(74) *Attorney, Agent, or Firm*—Richard E. Oney; Fennemore Craig, P.C.

(57) ABSTRACT

A holder for a mobile telephone includes a generally tube-shaped body comprising an exterior and an interior cavity having an opening at a first end of the body and an opening at an opposing second end of the body. The interior cavity has a surface comprising a material having frictional properties allowing the device to be slidingly inserted by hand into the interior of the tube-shaped body. The tube-shaped body is semi-rigid and sufficiently elastic so that the body can stretch to allow the hand insertion of the device into the interior of the body and can retain the inserted device in the interior of the body. The tube-shaped body can be positioned on a belt so that the belt extends through the interior cavity and out of the first opening and the second opening. A mobile electronic device can be slidingly inserted into the interior cavity, thereby stretching a portion of the body to cause the tube-shaped body to retain the inserted device in the interior cavity.

19 Claims, 4 Drawing Sheets

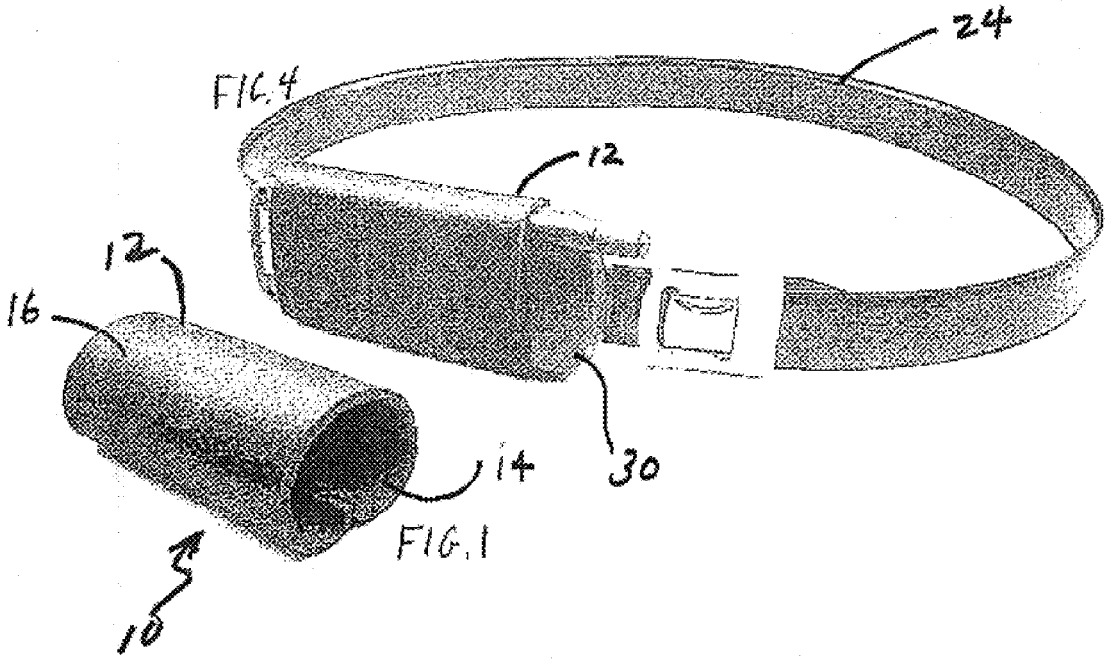
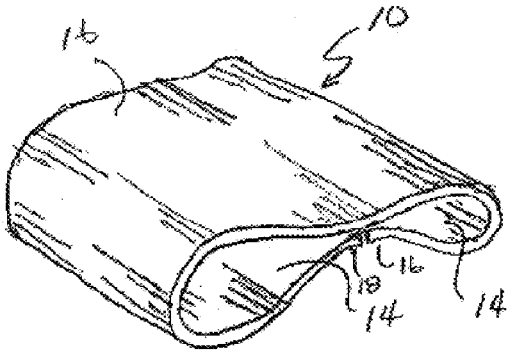
FIG. 7

24

12
10
30

MOBILE PHONE HOLDER

RELATED APPLICATION

This application claims the benefit of U.S. Provisional Application No. 60/277,707, filed Mar. 21, 2001, entitled "MOBILE PHONE HOLDER," which is incorporated herein by reference.

BACKGROUND

This invention relates to holders for portable electronic devices, such as mobile telephones. More particularly, it relates to such a holder that can be mounted to a belt or strap.

Holders for electronic devices such as mobile telephones have been used for some time. These holders, however, suffer from a number of shortcomings. Belt clip holders, in addition to being prone to breakage and subsequent dropping of the device, hold the device in an attitude perpendicular to the belt. This attitude forces the user to reposition or remove the device when sitting. Further, in a sitting position this attitude can make the removal of the device from the belt more difficult, which is inconvenient. Swiveling belt clip attachments have been developed to assist with this problem. However, such attachments, as well as belt loops, can allow the phone to swing annoyingly during vigorous movement of the user. To provide better protection for the device, holders have been fabricated of relatively hard material. These holders, however, can be uncomfortable to wear.

There is a need, therefore, for an improved mobile telephone holder that provides a secure attachment, that is inexpensive to manufacture and that is comfortable and easy to use.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided a holder for a mobile device. The holder comprises a generally tube-shaped body having an exterior, an interior cavity having an opening at a first end of the body and an opening at an opposing second end of the body. The interior cavity has a surface comprising a material having frictional properties allowing the device to be slidingly inserted by hand into the interior of the tube-shaped body. The tube-shaped body is semi-rigid and sufficiently elastic so that the body can stretch to allow the hand insertion of the device into the interior of the body and can retain the inserted device in the interior of the body.

In a preferred embodiment, the tube-shaped body is made of neoprene, the interior surface of the body can be lined with fleece-like material and the exterior of the tube-shaped body can be covered at least in part with a fabric. The tube-shaped body can be formed from a generally flat piece of elastic, semi-rigid material, with two of the opposing sides secured to each other to form a seam along at least a portion of the length of the tube-shaped body. Optionally, the tube-shaped body can include one or more slits disposed generally perpendicularly to a longitudinal axis of the interior cavity.

A method according to the invention includes providing a generally tube-shaped body like that described above, positioning the tube-shaped body on a belt so that the belt extends through the interior cavity and out of the first opening and the second opening and slidingly inserting the device into the interior cavity, thereby stretching a portion of the body to cause the tube-shaped body to retain the inserted device in the interior cavity.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred embodiments given below, serve to explain the principles of the invention.

FIG. 1 is a perspective view of a holder in accordance with the invention oriented in a horizontal position and showing the holder's tube structure and seam.

FIG. 4 shows the holder of FIG. 1 positioned on a belt as in FIG. 3 and holding a mobile telephone.

FIG. 7 shows another embodiment of a holder in accordance with the invention, which embodiment has two tubular cavities rather than one.

DESCRIPTION

Reference will now be made in more detail to the presently preferred embodiments of the invention as illustrated in the accompanying drawings, in which like numerals refer to like parts throughout the several views.

Referring to FIG. 1, one advantageous embodiment of a holder in accordance with the invention is shown. The holder, generally designated by the numeral 10, comprises a tube-shaped body 12 of neoprene or similar elastic, yet semi-rigid material. The material is covered on one side with a fleece-like layer 14 and on the other side with a thin, woven fabric layer 16. The fabric layer 16 can have logos applied, impressed, or embroidered thereon and preferably is washable.

Figure 2A:
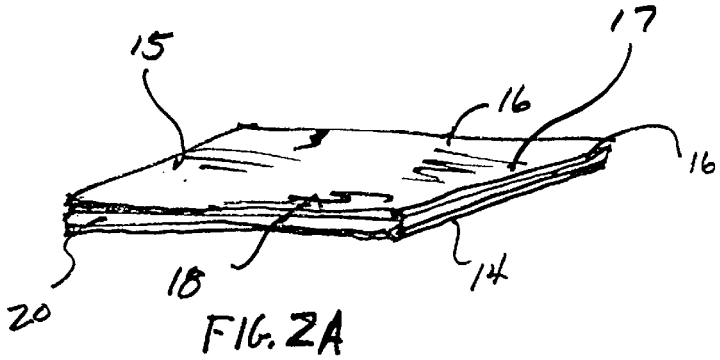
FIG. 2A is a perspective view of a blank that can be used to form the holder of FIG. 1.
Figure 2B:
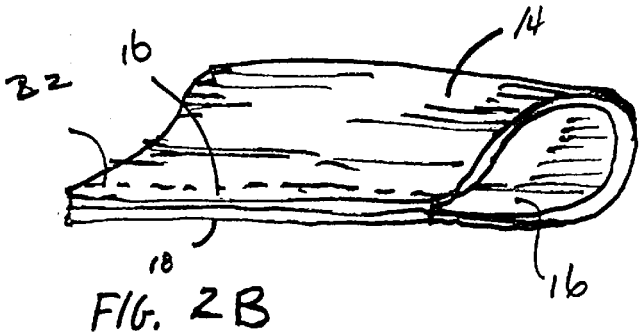
FIG. 2B is a perspective view showing how the blank of FIG. 2A can folded to form the holder of FIG. 1.

The tube 12 is formed from a flat piece of material (or blank) 20, as shown in FIG. 2A, with two opposing side portions or edges 16, 18 and two opposing end portions 15, 17. The material 20 can be cut to the appropriate shape and size by shearing, die cutting or similar means. To form the tube 12, the edges 16, 18 are folded flat against each other so as to position the fleece layer 14 on the outside, as shown in FIG. 2B. The opposing edges 16, 18 are attached to each other such as by sewing them together to form a seam 22. Alternatively, the edges 16, 18 can be attached to each other via bonding, staking, melting, or other similar means. Excess material beyond the seam 22 can be trimmed to reduce bulk, and the tube 12 is rolled inside out, leaving the fleece layer 14 on the inside.

Preferably, the blank is about 6 inches by about 4 inches and the elastic material is about ⅛ inch thick. The linear dimension of material (circumference of the tube) from one side of the seam to the other is about 5.5 inches. This yields a tube diameter of about 1¾ inches and a tube length of about 4 inches. By adjusting the dimensions of the blank, the diameter of the tube 12 can be adjusted to size for the device to be enclosed and the length of the tube 12 can be adjusted for distance between belt loops. To manufacture multiple holders, long strips of material can be sewn into sleeve-like long tubes, using the process described above with respect to FIGS. 2A and 2B, and these can be cut to length to form holders 10 of the desired dimensions.

Figure 3:
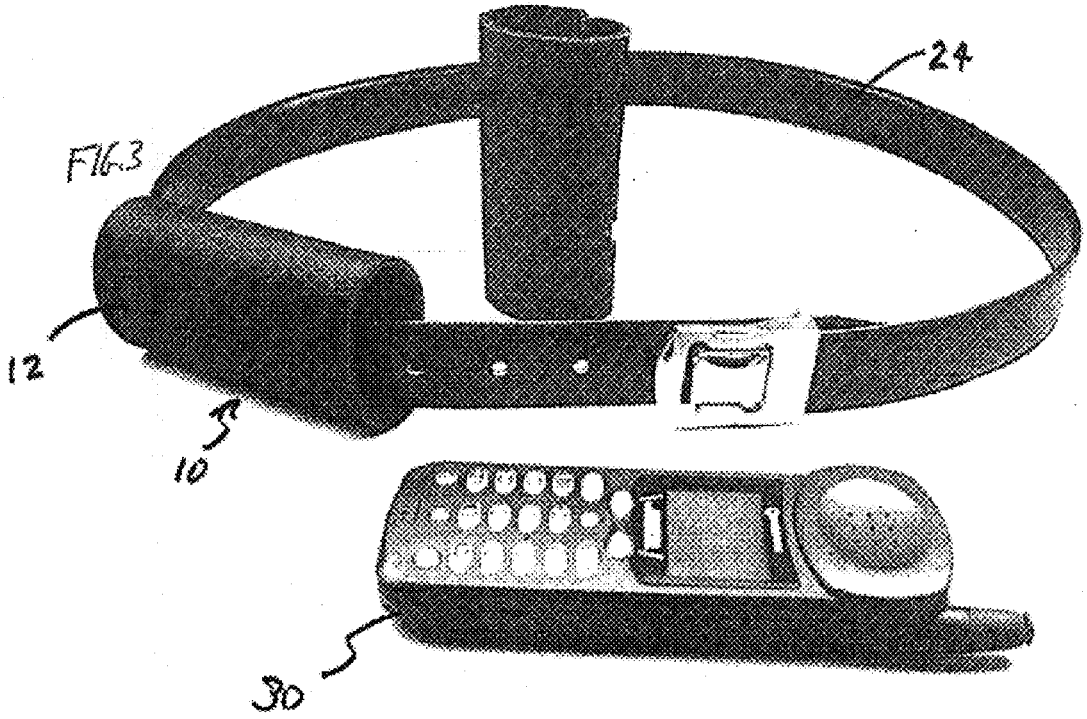
FIG. 3 shows the holder of FIG. 1 positioned on a belt.
Figure 5:
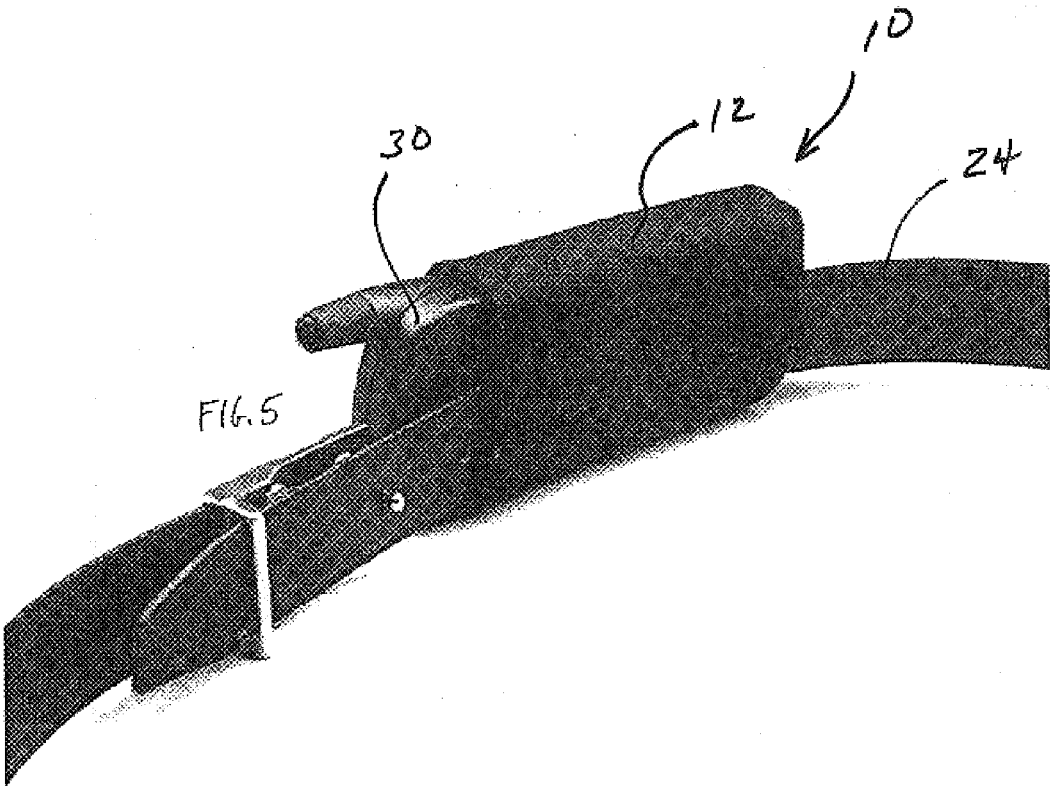
FIG. 5 shows another view of the holder of FIG. 1 positioned on a belt and holding a mobile telephone.

Referring to FIG. 3, to use the holder 10 with a belt 24, the belt 24 is threaded through the holder 10 as the belt is threaded between two belt loops (not shown). Thereafter, the holder 10 is held on the belt 24 between the two belt loops. Due to the semi-rigid nature of the material forming the holder 10, the tube body 12 tends to retain its shape to remain somewhat circular in cross section, so as to easily accept a mobile phone, similar portable electronic device, or similarly shaped tool or other object. As shown in FIGS. 4 and 5, the mobile phone 30 is inserted into the holder 10 by hand with a motion parallel to the belt 24. The elasticity of the material 20 allows the holder 10 to stretch slightly as the device 30 is inserted. The fleece lining 16 allows the device 30 to easily slide into the interior of the holder 10. Once the device is fully inserted, the elasticity of the tube 10 holds the device 30 firmly in place.

The holder 10 can be used in similar fashion on a strap, such as a purse strap, rather than a belt. It can also be used on the shoulder or belt strap of a backpack, a fanny pack strap, on a dedicated waist or shoulder strap, or with a strap incorporated into the body of the holder 10. It will be understood that the use of the term "belt" also includes straps and similar structures.

Figure 6:
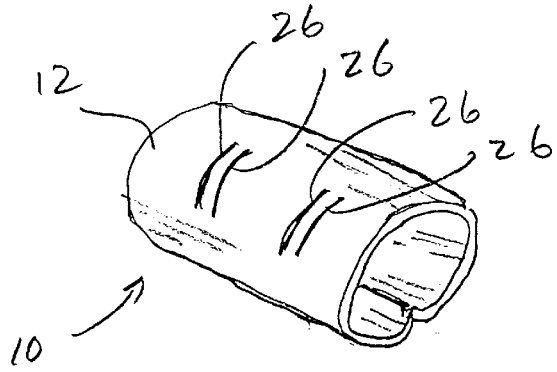
FIG. 6 shows an embodiment of a holder in accordance with the invention with slits disposed in the body of the holder perpendicular to the longitudinal axis of the interior cavity of the holder.

Alternative embodiments of the holder can also be manufactured. As shown in FIG. 6, during the fabrication process one or more slits 26 can be cut into the tube body 12 perpendicular to the longitudinal axis of the interior cavity. The slits 26 can allow the user to position the holder 10 directly over a given belt loop, with the belt loop fitting against the area of the tube body 12 where the slits 26 are disposed. In this way, the slits 26 can yield greater flexibility in positioning the holder 10 for comfort or functionality.

Another alternative to sewing the edges 16, 18 of the blank 20 together is attaching hook-and-loop material, such as Velcro (not shown), to the edges 16, 18. In this embodiment the user can attach the holder 10 to his or her belt or purse strap without removing the belt or strap. This feature is particularly useful in cases where the belt or strap is not easily detached and reattached. This feature also allows for some variation in the size of device 30 that the holder 10 can accommodate. A hook-and-loop closure also enables attachment of the holder 10 to objects such as golf carts, bicycle handlebars, car shift levers and similar uses.

The ends of the holder 10 can be formed so as to provide flaps or similar restrictive features to further enhance the security of the enclosed device. Elastic (either separate material or formed from the contiguous material of the holder by folding and sewing), hook-and-loop material, zippers, or snaps can all be used to enclose the ends and/or secure the flaps. The end features can be designed—along with the fastening method of the original blank—so as to provide for a waterproof enclosure. In this embodiment, the holder is formed as a plurality of tubes to provide for isolation of the interior from the strap to which the holder is attached. The ends of the holder can be finished with piping for improved appearance and greater durability.

In another advantageous embodiment, the holder 10 can be fabricated as a body 12 having a pair of tubular cavities instead of a single tube. As shown in FIG. 7, this can be achieved by attaching the edges 16, 18 of the blank 20 to the blank body 20 at a position intermediate the edges 16, 18. In this embodiment, the belt or strap can be positioned within one tubular cavity and the device can be held in the other cavity. This embodiment allows for separation and isolation of the device from the belt or strap to which the holder is attached.

A pocket or pockets can be formed from the contiguous material of the holder 10, or from separate materials, so as to provide for the carriage of coins, bills, keys, pens, pencils, business cards, identification and/or credit cards. This feature can be particularly useful for application of the holder to casual recreational activities where a user would be inconvenienced by carrying a wallet or purse. Elastic, zippers, snaps, or hook-and-loop material can close these pockets.

For recreational sporting activities the holder can be fabricated from a long, continuous piece of material, wider in the area where the tube is to be formed, so as to provide an integral belt or strap. The ends of this belt can be fastened together with hook-and-loop material, zippers, snaps, or other fasteners.

The holder can also be used so as to leave the seam on the outside. This yields a teardrop cross sectional shape that allows the holder to lay more flat to the belt when empty.

The holder can also be fabricated from two half-size blanks with seams exposed at the top and bottom. This enables the holder to lay completely flat when empty.

Holes can be punched or cut through the material for decorative or functional purposes.

The base material (e.g., neoprene) can be exposed at the portion of the holder in contact with the belt or strap to which it is attached, or in contact with the underlying garment. This aids in preventing the holder from unintended shifting or sliding along the belt or strap.

The above-described holder of the present invention possesses numerous advantages. It is easy and inexpensive to manufacture, and very durable. By holding the telephone or other device parallel to the belt, the invention provides a much more ergonomic and secure holder than conventional belt clips or belt loops. The horizontal attitude of this holder facilitates insertion and retrieval of devices into and from the holder with singular, ergonomic, and intuitive motion. Unlike hard cases, this holder is soft and much more comfortable to the wearer. The bulk of the material protects the enclosed device from impact. The nature of the material—particularly if using neoprene—provides a degree of water resistance to protect the device from accidental splashing. The elasticity of the material prevents the device from being accidentally dislodged, while the fleece lining provides for easy insertion and removal by deliberate action when desired. The open end of the tube allows a headset or other corded accessory to be inserted into an end of the device being held. Since the bottom of the device is closer to the user's ear than if the device were hanging vertically, the effective length of the cord is increased for greater range of motion of the user's head and body relative to the device. The user can trim the holder to length to accommodate shorter devices or shorter distances between belt loops. Logos applied to the tube can be positioned with the long axis horizontally for maximum recognition. The material used for constructing the holder is available in a variety of colors, to provide the user with choices to suit individual taste.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A holder and a mobile electronic device, the holder comprising:

a generally tube-shaped body having an exterior, and an interior cavity with an opening at a first end of the body;

the interior cavity having a surface comprising a material having frictional properties allowing the device to be slidably inserted by hand into the interior cavity of the tube-shaped body;

the tube-shaped body being semi-rigid and sufficiently elastic so that the body can stretch to allow the hand insertion of the device into the interior cavity of the body and can retain the inserted device in the interior of the body; and a belt or strap threaded through at least a portion of the interior of the body.

2. The holder of claim 1 wherein the tube-shaped body comprises neoprene.

3. The holder of claim 1 wherein the interior surface comprises a fleece material.

4. The holder of claim 1 wherein the exterior of the tube-shaped body is covered at least in part with a fabric.

5. The holder of claim 1 wherein the tube-shaped body comprises a generally flat piece of elastic, semi-rigid material, with two of the opposing sides secured to each other to form a seam along at least a portion of the length of the tube-shaped body.

6. The holder of claim 1 wherein the tube-shaped body includes one or more slits for receiving the belt or strap.

7. A holder for a mobile electronic device, the holder comprising in combination:

a generally tube-shaped body having an exterior and an interior cavity having an opening at a first end of the body and an opening at an opposing second end of the body;

the tube-shaped body being semi-rigid and sufficiently elastic so that the body can stretch to allow the hand insertion of the device into the interior of the body and can retain the inserted device in the interior cavity body; and a belt threaded through the interior cavity of the tube-shaped body.

8. The holder of claim 7 wherein the tube-shaped body comprises neoprene.

9. The holder of claim 7 wherein the interior cavity has a surface comprising a material having frictional properties allowing the device to be slidably inserted by hand into the interior of the tube-shaped body.

10. The holder of claim 9 wherein the interior surface comprises a fleece material.

11. The holder of claim 7 wherein the exterior of the tube-shaped body is covered at least in part with a fabric.

12. The holder of claim 7 wherein the tube-shaped body comprises a generally flat piece of elastic, semi-rigid material, with two of the opposing sides secured to each other to form a seam along at least a portion of the length of the tube-shaped body.

13. The holder of claim 7 wherein the tube-shaped body includes one or more slits disposed generally perpendicularly to the interior cavity.

14. A method for removably securing a mobile electronic device to a belt or strap, the method comprising:

providing a generally tube-shaped body having an exterior and an interior cavity having a first opening in the body and an opposing second opening in the body, wherein the tube-shaped body is semi-rigid and sufficiently elastic so that the body can stretch to allow the hand insertion of the device into the interior cavity and can retain the inserted device in the interior cavity; and positioning the tube-shaped body on a belt so that the belt extends through the interior cavity and out of the first opening and the second opening.

15. The method according to claim 14 further comprising slidably inserting the device into the interior cavity and thereby stretching a portion of the body to cause the tube-shaped body to retain the inserted device in the interior cavity.

16. The method according to claim 14 wherein the interior cavity of the tube-shaped body has a surface comprising a material having frictional properties allowing the device to be slidably inserted by hand into the interior of the tube-shaped body.

17. The method according to claim 16 wherein the surface of the interior cavity comprises a fleece material.

18. The method according to claim 14 wherein the exterior of the tube-shaped body is covered at least in part with a fabric.

19. The method according to claim 14 wherein the tube-shaped body comprises a generally flat piece of elastic, semi-rigid material, with two of the opposing sides secured to each other to form a seam along at least a portion of the length of the tube-shaped body.

* * * * *